US011592153B2

(12) United States Patent
Mitterlehner et al.

(10) Patent No.: US 11,592,153 B2
(45) Date of Patent: Feb. 28, 2023

(54) LIGHTING APPARATUS FOR A MOTOR VEHICLE HEADLAMP

(71) Applicant: ZKW Group GmbH, Wieselburg (AT)

(72) Inventors: Stefan Mitterlehner, Mank (AT); Thomas Mitterlehner, Mank (AT)

(73) Assignee: ZKW Group GmbH, Wieselburg (AT)

( * ) Notice: Subject to any disclaimer, the term of this patent is extended or adjusted under 35 U.S.C. 154(b) by 0 days.

(21) Appl. No.: 17/424,274

(22) PCT Filed: Dec. 12, 2019

(86) PCT No.: PCT/EP2019/084809
§ 371 (c)(1),
(2) Date: Jul. 20, 2021

(87) PCT Pub. No.: WO2020/151873
PCT Pub. Date: Jul. 30, 2020

(65) Prior Publication Data

US 2022/0065420 A1 Mar. 3, 2022

(30) Foreign Application Priority Data

Jan. 23, 2019 (EP) ..... 19153239

(51) Int. Cl.
*F21S 41/63* (2018.01)
*F21S 41/25* (2018.01)
(Continued)

(52) U.S. Cl.
CPC ..... *F21S 41/635* (2018.01); *F21S 41/143* (2018.01); *F21S 41/16* (2018.01); *F21S 41/18* (2018.01);
(Continued)

(58) Field of Classification Search
CPC ..... F21S 41/16; F21S 41/365; F21S 41/675; G02B 26/0833; G02B 26/105
See application file for complete search history.

(56) References Cited

U.S. PATENT DOCUMENTS 9,829,716 B1 11/2017 Huang
9,945,530 B2 * 4/2018 Hager ..... F21S 43/13
(Continued)

OTHER PUBLICATIONS

International Search Report for PCT/EP2019/084809, dated Feb. 21, 2020 (15 pages).
(Continued)

*Primary Examiner* — Eric T Eide
(74) *Attorney, Agent, or Firm* — Eversheds Sutherland (US) LLP

(57) ABSTRACT

A lighting device (10) for a motor vehicle headlamp, which lighting device comprises the following:

at least one first light source (50) for radiating light beams in a first radiation direction (X1), a first deflection device (100) with a deflection surface (110), which is set up to deflect at least a portion of the light beams of the at least one first light source (50) in a second radiation direction (X2), and a second deflection device (200) with a multiplicity of deflection elements which can be controlled and moved independently of one another for deflecting at least a portion of the light beams of the light beams deflected by the first deflection device (100) in a third radiation direction (X3) and for creating a light distribution in front of the lighting device (10), wherein the first deflection device (100) comprises at least one second light source (60), which at least one second light source (60) has a main radiation direction in which light beams of the second light source can be emitted, wherein the at least one second light source (60) is arranged on the
(Continued)

deflection surface (110) of the first deflection device (100) in such a manner that the main radiation direction is parallel to the second radiation direction (X2).

15 Claims, 3 Drawing Sheets

(51) Int. Cl.

| | |
|---|---|
| ***F21S 41/365*** | (2018.01) |
| ***F21S 41/16*** | (2018.01) |
| ***F21S 41/14*** | (2018.01) |
| ***F21S 41/143*** | (2018.01) |
| ***F21Y 113/20*** | (2016.01) |
| ***F21Y 115/30*** | (2016.01) |
| ***F21Y 115/10*** | (2016.01) |

(52) U.S. Cl.
CPC ..... *F21S 41/25* (2018.01); *F21S 41/365* (2018.01); *F21Y 2113/20* (2016.08); *F21Y 2115/10* (2016.08); *F21Y 2115/30* (2016.08)

(56) References Cited

U.S. PATENT DOCUMENTS

| | | | | |
|---|---|---|---|---|
| 11,099,472 | B2 * | 8/2021 | Hirasawa | H04N 9/3164 |
| 2010/0302514 | A1 | 12/2010 | Silverstein et al. | |
| 2012/0008098 | A1 | 1/2012 | Akiyama | |
| 2014/0028982 | A1 * | 1/2014 | Hadrath | F21S 41/16 353/121 |
| 2015/0176792 | A1 * | 6/2015 | Hager | F21S 45/47 362/510 |
| 2015/0270682 | A1 * | 9/2015 | Daniels | G03B 21/16 362/235 |
| 2015/0377430 | A1 * | 12/2015 | Bhakta | F21S 41/16 362/84 |
| 2016/0377252 | A1 * | 12/2016 | Bhakta | F21V 23/003 362/520 |
| 2018/0031202 | A1 * | 2/2018 | Bhakta | F21S 41/36 |
| 2018/0328563 | A1 * | 11/2018 | Park | G06V 20/584 |
| 2019/0024864 | A1 * | 1/2019 | Stein | F21S 41/143 |

OTHER PUBLICATIONS

Search Report for European Patent Application No. 19153239.9 dated Aug. 13, 2019 (8 pages).

* cited by examiner

LIGHTING APPARATUS FOR A MOTOR VEHICLE HEADLAMP

The invention relates to a lighting device for a motor vehicle headlamp, which lighting device comprises the following:

- at least one first light source for radiating light beams in a first radiation direction,
- a first deflection device with a deflection surface, which is configured to deflect at least a portion of the light beams of the at least one first light source in a second radiation direction, and
- a second deflection device with a plurality of deflection elements which can be controlled and moved independently of one another for deflecting at least a portion of the light beams of the light beams deflected by the first deflection device in a third radiation direction and for creating a light distribution in front of the lighting device.

Furthermore, the invention relates to a motor vehicle headlamp comprising at least one lighting device according to the invention.

When developing current headlamp systems, the desire is ever increasingly prevalent to be able to project a light image with as high a resolution as possible onto the carriageway, which can be changed quickly and can be adapted to the respective traffic, road and light conditions.

Here, the term "carriageway" is used for simplified representation, as whether a light image is actually located on the carriageway or also extends beyond that, for example onto the edge of the carriageway, of course depends on the local conditions.

In principle, the light image is described on the basis of a projection onto a vertical surface in accordance with the relevant standards, which relate to automotive lighting technology, wherein a variably controllable reflector surface is formed from a plurality of micromirrors and reflects light beams emitting from a first lamp in a radiation direction of the headlamp.

In this case, any desired light functions with different light distributions can be realized, such as for example a dipped beam light distribution, a static cornering light distribution, a town light distribution, a motorway light distribution, a dynamic cornering light distribution, a main beam light distribution or the imaging of non-dazzling main beam. Furthermore, symbol projections, such as for example danger symbols, navigation arrows, manufacturer logos or the like, can also take place.

What is known as "digital light processing" projection technology—termed DLP for short—is preferably used for the micromirror arrangement, in which the images are created in that a digital image is modulated onto a light beam. In this case, the light beam is broken down into part regions by means of a rectangular arrangement of movable micromirrors, also termed pixels, and subsequently reflected or deflected, pixel-by-pixel, either into the projection path or out of the projection path.

An optoelectronic component preferably forms the basis for this technology, which component contains the rectangular arrangement in the form of a matrix of micromirrors and their control technology, for example a "digital micromirror device"—DMD for short.

A DMD microsystem is a spatial light modulator (SLM), which consists of micromirror actuators arranged in a matrix-like manner, i.e. tiltable or pivotable mirroring surfaces, for example with an edge length of approximately 7 μm. The mirror surfaces are constructed in such a manner that they can be moved by means of the action of electrostatic fields.

The angle of each micromirror can be adjusted individually and generally has two stable end states, between which it is possible to change up to 5000 times within a second for example.

The number of micromirrors corresponds to the resolution of the projected image, wherein a micromirror can represent one or more pixels. Meanwhile, DMD chips are available with high resolutions in the megapixel range.

In currently used motor vehicle headlamps, the light distribution created can, for example for non-dazzling main beam, be controlled dynamically in such a manner that oncoming vehicles are detected and the light distribution created for example by a matrix made up of LED light sources is darkened in the direction of the oncoming vehicle.

Generally, in the field of high-resolution light systems, particularly in the field of DMD technology, the problem exists, that owing to limitations due to the light source which can be used for illuminating the DMD, no fully functional light function is to be expected. In particular, a fully functional main beam with a high maximum (greater than 100 lx) and a width of +/−20° (measured according to an ECE measuring screen) cannot be achieved. The main beam distribution that can be created by means of a DMD or DLP module is relatively narrow with maximum widths to be expected of +/−10°.

For this reason, further additional modules must be added, which create the full width of the main beam or the main beam distribution, wherein these additional modules typically have to be placed anywhere in the headlamp and are undesirable with respect to the design and the installation space taken away in the motor vehicle headlamp.

It is an object of the invention to provide an improved lighting device.

This object is achieved in that the first deflection device comprises at least one second light source, which at least one second light source has a main radiation direction in which light beams of the second light source can be emitted, wherein the at least one second light source is arranged on the deflection surface of the first deflection device in such a manner that the main radiation direction is parallel to the second radiation direction.

The at least one first light source is for example set up to realize a basic lighting or near field lighting in front of the lighting device, wherein the at least one second light source is provided to create an additional light spot, for example for a main beam distribution in front of the lighting device, or image the same onto the first deflection device.

The main radiation direction of the at least one second light source should to the greatest extent possible be virtually parallel or completely parallel to the second main radiation direction, as the second deflection device—if the same is constructed as a DMD—is specified with very small light entry angle ranges, i.e. if light beams hit the micromirrors of the DMD too steeply or too shallowly, this may lead to backlighting of the micromirrors, which in turn leads to scattered light in the projected light image and thus to a poor light-dark contrast, which is extremely important for use for a motor vehicle headlamp.

Small angular deviations—insofar as these are found in the predetermined angular range of the DMD—are permitted however and even geometrically necessary in the case of the use of a plurality of second light sources (due to the offset of the light sources with respect to one another).

It is noted that the term "can be projected in front of the lighting device" means a projection in the direction of travel of a motor vehicle, in which the lighting device is installed.

In this context, the term "direction of travel" means the direction in which a driven motor vehicle—as constructively provided—is moving. A technically possible backwards travel is not defined as direction of travel in this context.

"Main radiation direction" is to be understood as the direction in which the first or the second light source radiates light most strongly or most as a consequence of its directionality.

It may advantageously be provided that the at least one second light source is arranged at the geometric centre of the deflection surface of the first deflection device, wherein the deflection surface preferably has a recess for the at least one second light source.

Geometric centre is for example also understood to mean the geometric centre of gravity. Mathematically, this corresponds to the averaging of all points inside a figure, in this case a surface. Such surfaces may for example also be constructed as quadrics, that is to say second order surfaces.

The geometric centre is for example also understood to mean the point on a paraboloid (or hyperboloid) at which the axis of rotation, about which a parabola (or hyperbola) is rotated in order to create a paraboloid, intersects the paraboloid surface.

The first deflection device may for example be designed in such a manner that the same or the deflection surface has a passage or opening, through which the at least one second light source can emit light beams onto the second deflection device.

It may be provided that the first deflection device has a holder, on which the deflection surface is arranged, wherein the holder has an opening, in which the at least one second light source is arranged.

In a practical embodiment of the invention, it may be provided that the holder is constructed and set up as a heat sink to dissipate the heat created at the at least one second light source.

It may be beneficial if the first deflection device has exactly one second light source.

It may be provided that the at least one second light source is constructed as a light-emitting diode or as a laser light source with a light conversion means.

As laser devices generally radiate coherent monochromatic light or light in a narrow wavelength range, but in a motor vehicle headlamp white mixed light is preferred or legally prescribed in general for the radiated light, what are known as light conversion elements are arranged in the radiation direction of the laser device for converting essentially monochromatic light into white or polychromatic light, wherein "white light" is understood to mean light of such a spectral composition, which inspires the colour impression "white" in humans. This light conversion element is for example constructed in the form of one or more photoluminescence converters or photoluminescence elements, wherein incident laser beams of the laser device hit the light conversion element, which generally has photoluminescent dye, and excite this photoluminescent dye to photoluminescence, and in the process emit light in a wavelength or wavelength ranges different from the light of the irradiating laser device. The light emission of the light conversion element in this case essentially has characteristics of a Lambertian radiator.

In the case of light conversion elements, a distinction is made between reflective and transmissive conversion elements.

The terms "reflective" and "transmissive" here relate to the blue portion of the converted white light. In the case of a transmissive design, the main propagation direction of the blue light portion is substantially rectified to the propagation direction of the output laser beam after passage through the converter volume or conversion element. In the case of a reflective design, the laser beam is reflected or deflected on a boundary surface that can be attributed to the conversion element, so that the blue light portion has a different propagation direction from the laser beam, which is generally realized as a blue laser beam.

It may further be provided that the at least one second light source has an adapter optical element, which adapter optical element is constructed as a collimator.

Collimator is understood to mean such a device which is set up to align light beams parallel to one another.

Advantageously, it may be provided that an adapter optical element is connected downstream of the at least one first light source.

The adapter optical element is therefore located in the beam path of the first light source between the first light source and the first deflection device.

Here, it may be provided that the adapter optical element is constructed as a collimator.

It may advantageously be provided that the second deflection device is constructed as a digital micromirror array with a multiplicity of micromirrors which are arranged next to one another in an array-like manner and can be controlled individually or in groups.

The angle of each micromirror can be adjusted individually and generally has two stable end states, between which it can be tilted.

Advantageously, the second deflection device can be constructed as a DMD.

The shape of the radiated light distribution of the lighting device, but also the luminous intensity distribution inside the radiated light distribution can be varied by targeted movement of individual or a group of selected deflection elements. The radiated light distribution can therefore be changed dynamically both with regards to its shape (expansion and/or extension) and also with regards to its brightness distribution. The control of the deflection elements and thus the variation of the radiated light distribution may take place as a function of operating parameters of the motor vehicle (e.g. vehicle speed, load, steering angle, transverse acceleration, etc.). When controlling the deflection elements, environmental parameters of the vehicle, (e.g. outside temperature, precipitation, other detected road users in the vicinity of the vehicle, etc.) can also be taken into account.

It may be provided that the at least one first light source is constructed as at least one light-emitting diode.

Preferably, it is provided that in the event of two or more light-emitting diodes being provided, each diode can be controlled independently of the other light-emitting diodes.

Each light-emitting diode can therefore be switched on and off independently of the other light-emitting diodes of a light source and preferably, if these are dimmable light-emitting diodes, also dimmed independently of the other light-emitting diodes of the light source.

It may further be provided that the lighting device comprises at least two first light sources, preferably exactly two first light sources.

It may be beneficial if the first radiation direction is parallel to the third radiation direction.

It may be provided that the deflection surface of the first deflection device is constructed as a hyperbolic or as a parabolic reflector.

Fundamentally, the deflection surface can also have other shapes, for example of an ellipsoid.

It may be provided that the first deflection device bundles light beams of the at least one first light source to a point, which is located in the direction of the second radiation direction behind the second deflection device.

The object is likewise achieved by a motor vehicle headlamp having at least one lighting device according to the invention.

The invention is explained in more detail in the following on the basis of exemplary drawings.

In the figures

Figure 1:
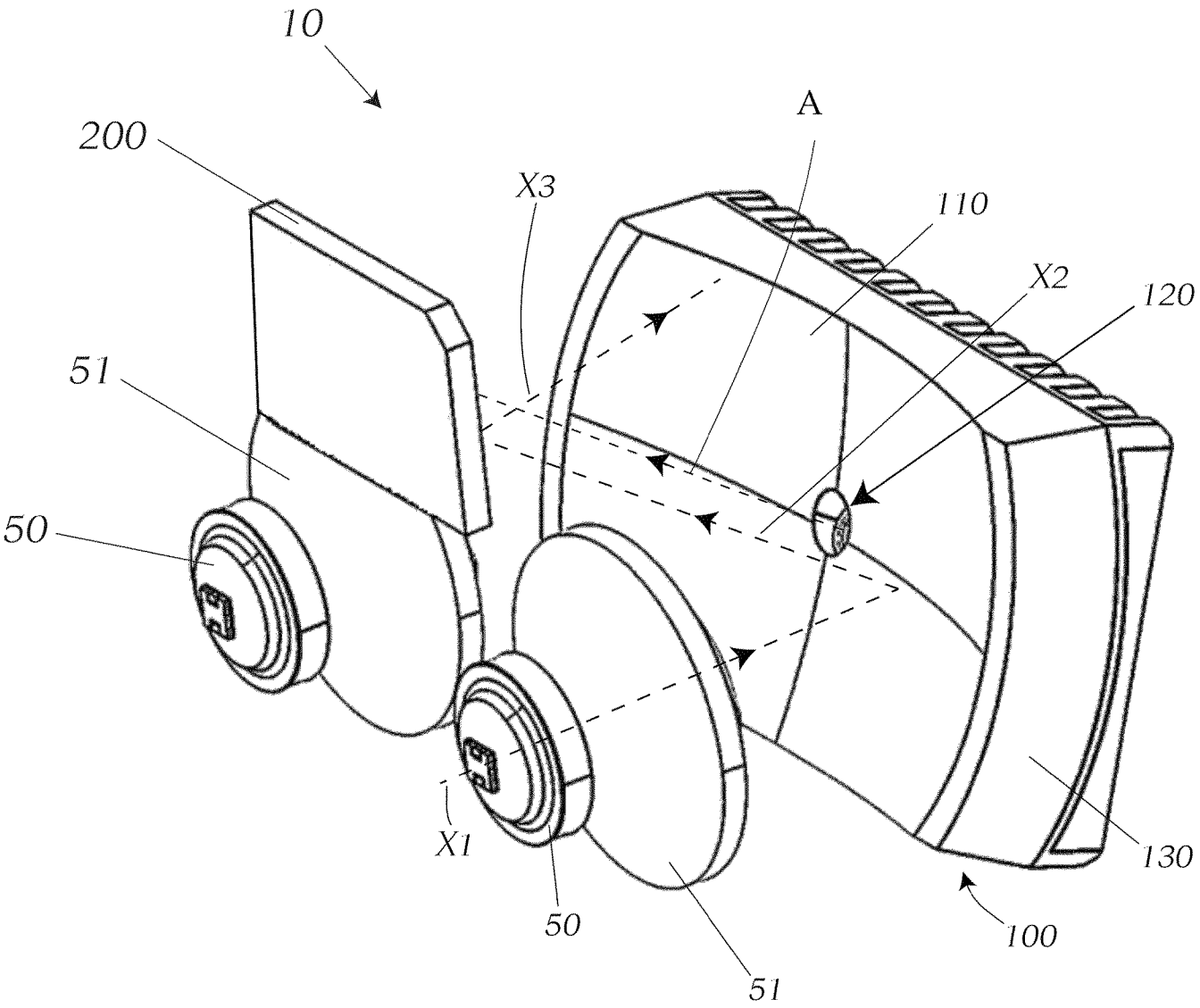
FIG. 1 shows a perspective view of an exemplary lighting device having first light sources, a first deflection device having a second light source and a second deflection device.

FIG. 1 shows an exemplary lighting device 10 for a motor vehicle headlamp, which lighting device 10 comprises two first light sources 50, which are provided for radiating light beams in a first radiation direction X1 and are constructed as light-emitting diodes, and a first deflection device 100 with a deflection surface 110, which deflection surface 110 is set up to deflect at least a portion of the light beams of the first light sources 50 in a second radiation direction X2. The first deflection device 100 further comprises a holder 130, on which holder 130 the deflection surface 110 is arranged or fastened.

An adapter optical element 51 is in each case connected downstream of the first light sources 50, which adapter optical elements 51 are constructed as collimators and align the light beams emitted by the light sources 50 parallel to one another, wherein the parallel directed light beams are radiated onto the first deflection device 100 or onto the deflection surface 110.

The lighting device 10 further comprises a second deflection device 200, which is constructed as a digital micromirror array (DMD for short) with a multiplicity of micromirrors which are arranged next to one another in an array-like manner and can be controlled individually or in groups, wherein the micromirrors can be controlled and moved independently of one another, and wherein the micromirror is provided for deflecting at least a portion of the light beams of the light beams deflected by the first deflection device 100 in a third radiation direction X3 and for creating a light distribution in front of the lighting device 10.

Here, the angle of each micromirror can be adjusted individually and generally has two stable end states, between which it can be tilted.

Figure 2:
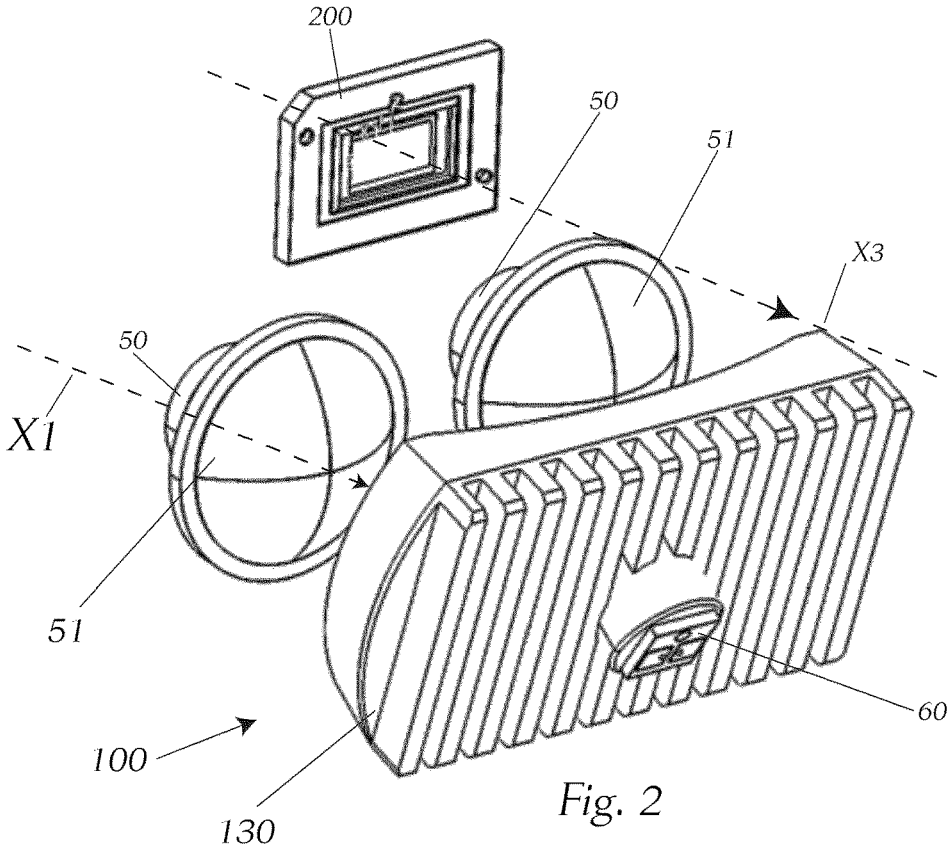
FIG. 2 shows the exemplary lighting device from FIG. 1 in a different perspective.

The first radiation direction X1 may be arranged parallel to the third radiation direction X3, as can be seen in the example shown in FIGS. 1 and 2.

Figure 3:
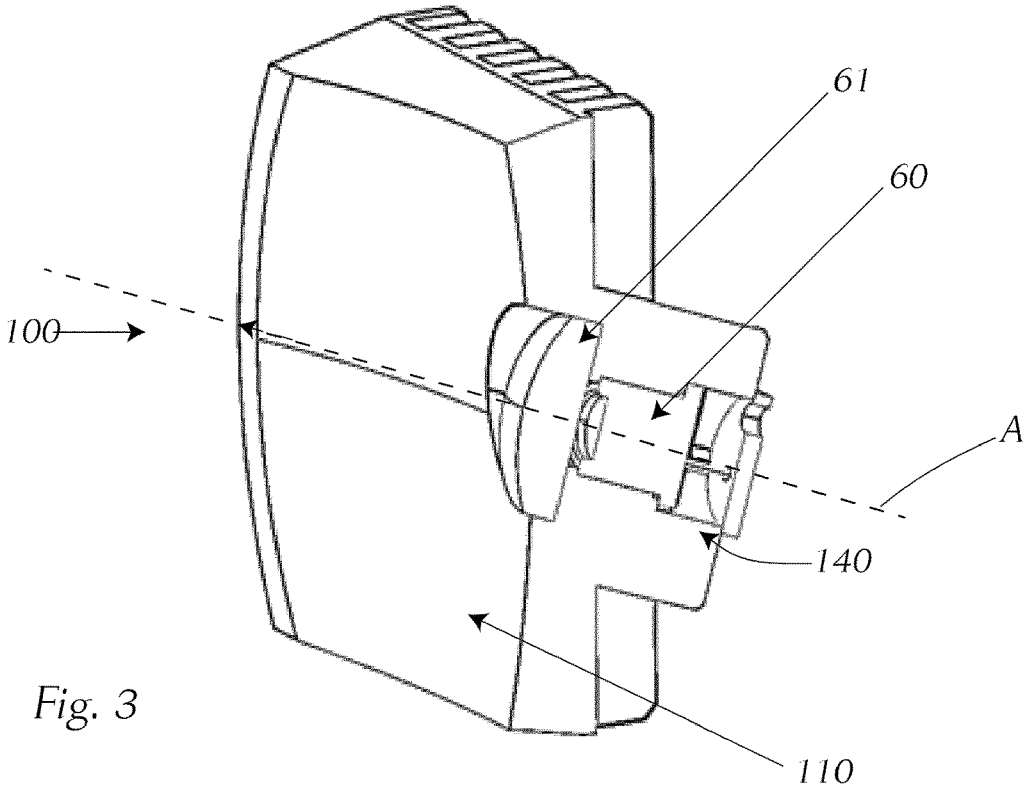
FIG. 3 shows a section through the first deflection device.

FIG. 3 shows a detailed sectional view of the first deflection device 100, wherein it can be seen that the first deflection device 100 comprises a second light source 60, which has a main radiation direction A, in which light beams of the second light source 60 can be emitted, wherein the second light source 60 is arranged at the geometric centre of the deflection surface 110. The holder 130 has an opening 140 for this, in which the second light source 60 is arranged, wherein the deflection surface 110 has a recess 120 for the second light source 60, so that the light beams that can be emitted by the second light source 60 can be radiated onto the second deflection device 200 in the direction of the second radiation direction X2. The main radiation direction A of the second light source 60 is in this case arranged parallel to the second radiation direction X2 or the second light source 60 radiates substantially in the same direction in which the light beams of the first light sources 50 are deflected by the first deflection device 100.

Geometric centre is for example also understood to mean the geometric centre of gravity. Mathematically, this corresponds to the averaging of all points inside a figure, in this case a surface. Such surfaces may for example also be constructed as quadrics, that is to say second order surfaces.

The deflection surface 110 can for example be constructed as a parabolic or as a hyperbolic reflector or reflector surface.

The geometric centre can here also be understood to mean the point on a paraboloid (or hyperboloid) at which the axis of rotation, about which a parabola (or hyperbola) is rotated in order to create a paraboloid (or hyperboloid), intersects the paraboloid surface (hyperboloid surface).

The deflection surface 110 or the first deflection device 100 can also be constructed in such a manner that the light beams of the first light sources are bundled substantially to a point, which point is located in the direction of the second radiation direction X2 behind the second deflection device 200.

This point may also be understood to mean a region with spatial extent, wherein this generally means that the parallel directed light beams of one of the first light sources 50 intersect the parallel directed light beams of the other first light source 50 in a point or region.

The second light source 60 is constructed in the example shown in the figures as a laser light source with a light conversion element, wherein an adapter optical element 61, which is constructed as a collimator, is connected downstream of the second light source 60 in the main radiation direction A.

Figure 4:
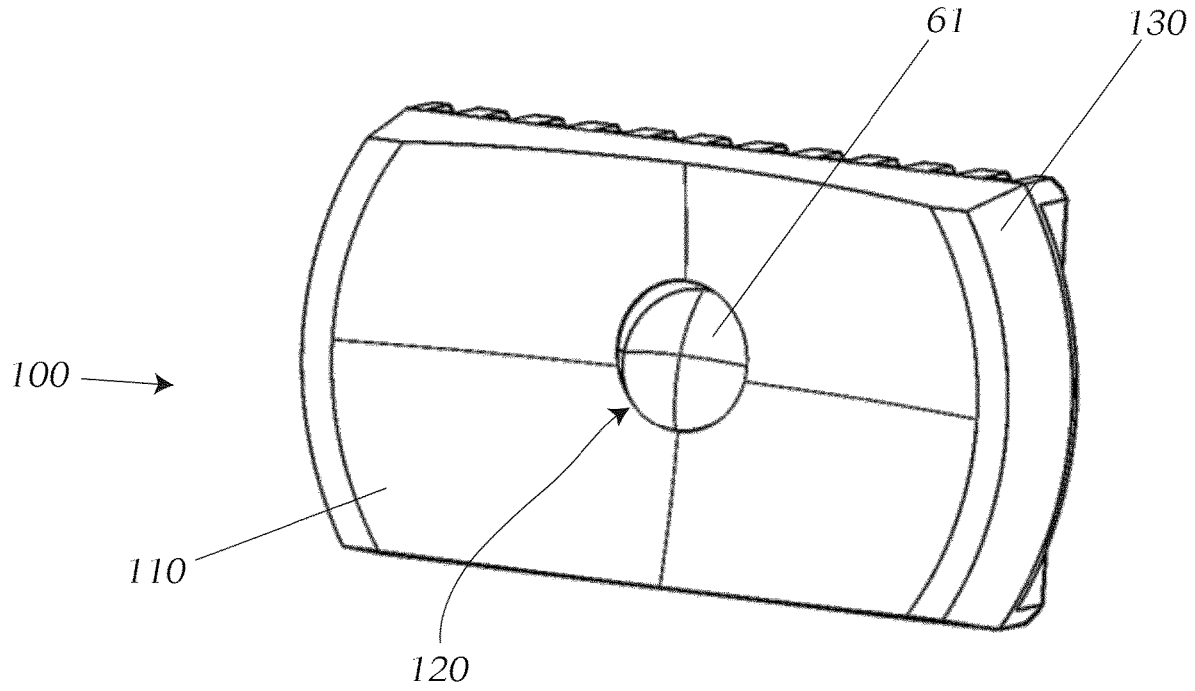
FIG. 4 shows a perspective front view of the first deflection device.

FIG. 4 shows a perspective front view of the first deflection device 100, wherein once again the deflection surface 110 and the recess 120 provided on the deflection surface 110 can be seen.

Figure 5:
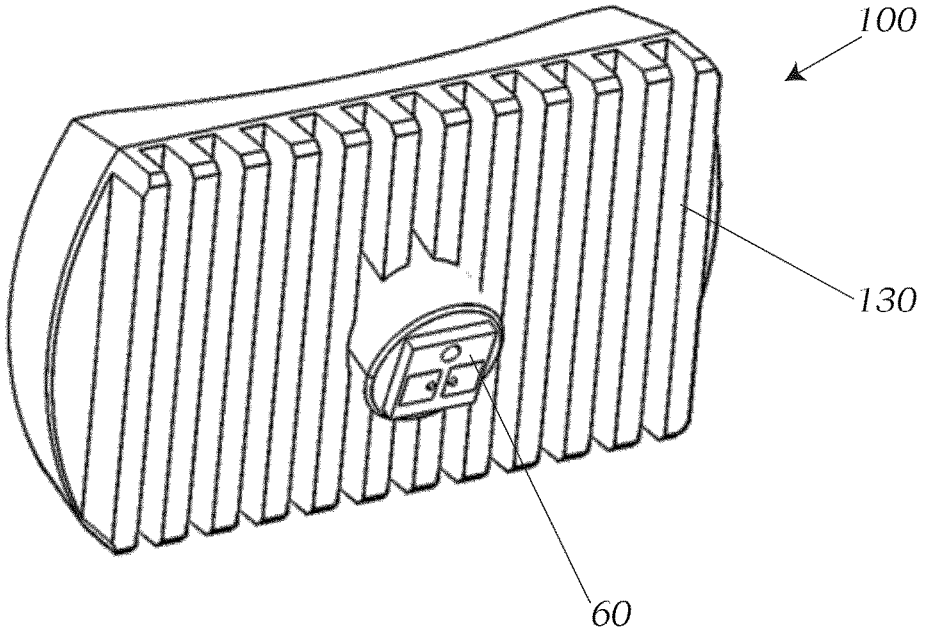
FIG. 5 shows a perspective rear view of the first deflection device.

FIG. 5 shows a perspective rear view of the first deflection device 100, wherein the holder 130 can be seen more clearly, wherein the holder 130 is constructed as a heat sink, which heat sink is set up to dissipate the heat created at the second light source 60, preferably to the surroundings.

LIST OF REFERENCE NUMBERS

Lighting device . . . 10
First light source . . . 50
Adapter optical element, first light source . . . 51
Second light source . . . 60
Adapter optical element, second light source . . . 61
First deflection device . . . 100
Deflection surface . . . 110
Recess, deflection surface . . . 120
Holder . . . 130
Opening, holder . . . 140
Second deflection device . . . 200
First radiation direction . . . X1
Second radiation direction . . . X2
Third radiation direction . . . X3
Main radiation direction . . . A

The invention claimed is:

1. A lighting device (10) for a motor vehicle headlamp, the lighting device comprising:

at least one first light source (50) for radiating light beams in a first radiation direction (X1);

a first deflection device (100) with a deflection surface (110), which is configured to deflect at least a portion of the light beams of the at least one first light source (50) in a second radiation direction (X2); and a second deflection device (200) with a plurality of deflection elements which can be controlled and moved independently of one another for deflecting at least a portion of the light beams of the light beams deflected by the first deflection device (100) in a third radiation direction (X3) and for creating a light distribution in front of the lighting device (10), wherein the first deflection device (100) comprises at least one second light source (60), which at least one second light source (60) has a main radiation direction in which light beams of the second light source can be emitted, wherein the at least one second light source (60) is arranged on the deflection surface (110) of the first deflection device (100) in such a manner that the main radiation direction is parallel to the second radiation direction (X2), wherein the first deflection device (100) has a holder (130), on which the deflection surface (110) is arranged, wherein the holder (130) has an opening (140), in which the at least one second light source (60) is arranged.

2. A lighting device (10) for a motor vehicle headlamp, the lighting device comprising:

at least one first light source (50) for radiating light beams in a first radiation direction (X1);

a first deflection device (100) with a deflection surface (110), which is configured to deflect at least a portion of the light beams of the at least one first light source (50) in a second radiation direction (X2); and a second deflection device (200) with a plurality of deflection elements which can be controlled and moved independently of one another for deflecting at least a portion of the light beams of the light beams deflected by the first deflection device (100) in a third radiation direction (X3) and for creating a light distribution in front of the lighting device (10), wherein the first deflection device (100) comprises at least one second light source (60), which at least one second light source (60) has a main radiation direction in which light beams of the second light source can be emitted, wherein the at least one second light source (60) is arranged on the deflection surface (110) of the first deflection device (100) in such a manner that the main radiation direction is parallel to the second radiation direction (X2), and wherein the at least one second light source (60) is arranged at the geometric centre of the deflection surface (110) of the first deflection device (100), wherein the deflection surface (110) has a recess (120) for the at least one second light source (60).

3. The lighting device according to claim 1, wherein the holder (130) is constructed and configured as a heat sink to dissipate heat created at the at least one second light source (60).

4. The lighting device according to claim 1, wherein the first deflection device (100) has exactly one second light source (60).

5. A lighting device (10) for a motor vehicle headlamp, the lighting device comprising:

at least one first light source (50) for radiating light beams in a first radiation direction (X1);

a first deflection device (100) with a deflection surface (110), which is configured to deflect at least a portion of the light beams of the at least one first light source (50) in a second radiation direction (X2); and a second deflection device (200) with a plurality of deflection elements which can be controlled and moved independently of one another for deflecting at least a portion of the light beams of the light beams deflected by the first deflection device (100) in a third radiation direction (X3) and for creating a light distribution in front of the lighting device (10), wherein the first deflection device (100) comprises at least one second light source (60), which at least one second light source (60) has a main radiation direction in which light beams of the second light source can be emitted, wherein the at least one second light source (60) is arranged on the deflection surface (110) of the first deflection device (100) in such a manner that the main radiation direction is parallel to the second radiation direction (X2), and wherein the at least one second light source (60) is constructed as a light-emitting diode or as a laser light source with a light conversion means.

6. A lighting device (10) for a motor vehicle headlamp, the lighting device comprising:

at least one first light source (50) for radiating light beams in a first radiation direction (X1);

a first deflection device (100) with a deflection surface (110), which is configured to deflect at least a portion of the light beams of the at least one first light source (50) in a second radiation direction (X2); and a second deflection device (200) with a plurality of deflection elements which can be controlled and moved independently of one another for deflecting at least a portion of the light beams of the light beams deflected by the first deflection device (100) in a third radiation direction (X3) and for creating a light distribution in front of the lighting device (10), wherein the first deflection device (100) comprises at least one second light source (60), which at least one second light source (60) has a main radiation direction in which light beams of the second light source can be emitted, wherein the at least one second light source (60) is arranged on the deflection surface (110) of the first deflection device (100) in such a manner that the main radiation direction is parallel to the second radiation direction (X2), and wherein the at least one second light source (60) has an adapter optical element (61), which adapter optical element (61) is constructed as a collimator.

7. The lighting device according to claim 1, wherein an adapter optical element (51) is connected downstream of the at least one first light source (50), which adapter optical element (51) is constructed as a collimator.

8. The lighting device according to claim 1, wherein the second deflection device (200) is constructed as a digital micromirror array with a multiplicity of micromirrors which are arranged next to one another in an array-like manner and can be controlled individually or in groups.

9. The lighting device according to claim 1, wherein the at least one first light source (50) is constructed as at least one light-emitting diode.

10. The lighting device according to claim 1, wherein the lighting device (10) comprises at least two first light sources (50).

11. The lighting device according to claim 1, wherein the first radiation direction (X1) is parallel to the third radiation direction (X3).

12. A lighting device (10) for a motor vehicle headlamp, the lighting device comprising:

at least one first light source (50) for radiating light beams in a first radiation direction (X1);

a first deflection device (100) with a deflection surface (110), which is configured to deflect at least a portion of the light beams of the at least one first light source (50) in a second radiation direction (X2); and a second deflection device (200) with a plurality of deflection elements which can be controlled and moved independently of one another for deflecting at least a portion of the light beams of the light beams deflected by the first deflection device (100) in a third radiation direction (X3) and for creating a light distribution in front of the lighting device (10), wherein the first deflection device (100) comprises at least one second light source (60), which at least one second light source (60) has a main radiation direction in which light beams of the second light source can be emitted, wherein the at least one second light source (60) is arranged on the deflection surface (110) of the first deflection device (100) in such a manner that the main radiation direction is parallel to the second radiation direction (X2), and wherein the deflection surface (110) of the first deflection device (100) is constructed as a hyperbolic or parabolic reflector.

13. The lighting device according to claim 1, wherein the first deflection device (100) is configured to bundle light beams of the at least one first light source (50) to a point, which is located in the direction of the second radiation direction (X2) behind the second deflection device (200).

14. A motor vehicle headlamp having at least one lighting device according to claim 1.

15. The lighting device according to claim 10, wherein the lighting device (10) comprises exactly two first light sources (50).

* * * * *